US008096679B2

(12) United States Patent
Chen et al.

(10) Patent No.: US 8,096,679 B2
(45) Date of Patent: Jan. 17, 2012

(54) REFLECTOR AND LED LIGHT-EMITTING UNIT USING THE SAME

(75) Inventors: Chin-Chung Chen, Taipei Hsien (TW); Hai-Wei Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 297 days.

(21) Appl. No.: 12/534,801

(22) Filed: Aug. 3, 2009

(65) Prior Publication Data

US 2010/0271821 A1 Oct. 28, 2010

(30) Foreign Application Priority Data

Apr. 23, 2009 (CN) ..... 2009 1 0301788

(51) Int. Cl.
*F21V 7/00* (2006.01)

(52) U.S. Cl. ... 362/247; 362/346; 362/241; 362/296.05; 362/296.07; 362/296.08

(58) Field of Classification Search ..... 362/241, 362/247, 296.05–296.08, 297, 298, 346
See application file for complete search history.

(56) References Cited

U.S. PATENT DOCUMENTS 7,193,243 B2 * 3/2007 Park ..... 257/80
7,270,449 B2 * 9/2007 Uke ..... 362/350

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

An LED light-emitting unit comprises an LED element having an optical axis and a reflector covering the LED element. The reflector comprises a light-reflecting unit recessed downwardly from a top surface of a top wall of the reflector and located corresponding to the LED element. The light-reflecting unit has a reflecting face comprising two curved faces intersecting with each other at two lines. The curved faces have axes intersecting with each other. A distance between two intersecting points of the two lines with a cross section of the reflector which is parallel to the top surface of the top wall of the reflector is larger than that between any other two intersecting points of the reflecting face intersecting with the cross section of the reflector.

16 Claims, 9 Drawing Sheets

REFLECTOR AND LED LIGHT-EMITTING UNIT USING THE SAME

BACKGROUND

1. Technical Field

The disclosure relates to an optical device and, more particularly, to a reflector and an LED (light emitting diode) light-emitting unit employing the reflector.

2. Description of Related Art

Generally, a most commonly used light-emitting unit includes a light-emitting element and a reflector mounted around the light-emitting element for reflecting light emitted from the light-emitting element. The reflector includes a light-reflecting unit surrounding the light-emitting element. The light-reflecting unit has a hemispheric face converging the light emitted from the light-emitting element within a substantially round region. When the light-emitting unit is utilized in a road illumination, there are identical illumination regions in a longitudinal direction of the road and in a lateral direction of the road. In order to achieve a desired illumination which has a wider illumination region along the longitudinal direction of the road and a narrower illumination region along the lateral direction of the road, the reflector needs to be amended.

What is needed, therefore, is a reflector capable of guiding light emitted from a light-emitting element to be in a wider illumination region along the longitudinal direction of the road and a narrower illumination region along the lateral direction of the road and a light-emitting unit using the reflector.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
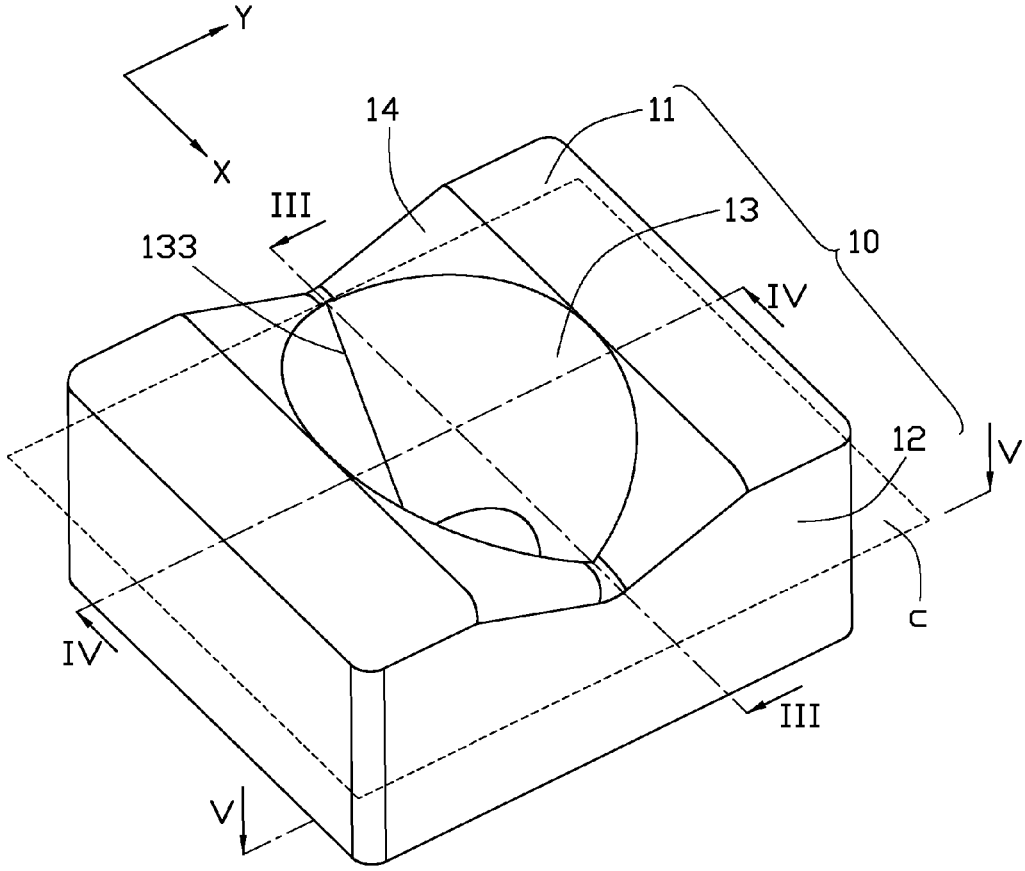
FIG. 1 is an isometric, assembled view of an LED light-emitting unit in accordance with a first embodiment of the disclosure.
Figure 2:
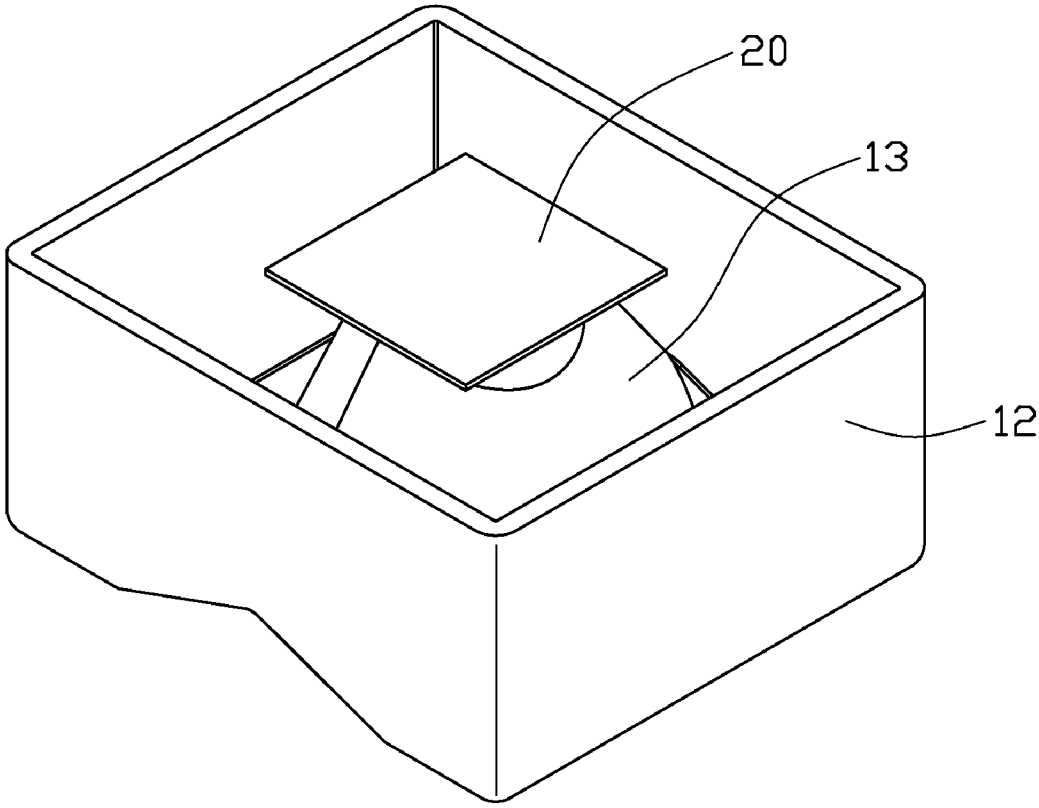
FIG. 2 is an inverted view of the LED light-emitting unit in FIG. 1.

Referring to FIGS. 1-2, an LED light-emitting unit in accordance with a first embodiment includes a light-emitting element 20 and a reflector 10 mounted around the light-emitting element 20. In this embodiment, the light-emitting element 20 is an LED (light emitting diode) module 20. In order to more clearly introduce the LED light-emitting unit, a 2D coordinate (see FIG. 1) is established to have an axis X (from left to right) and an axis Y (from front to rear) perpendicular to the axis X, both of which cooperatively define a plane perpendicular to a vertical direction. The LED light-emitting unit is symmetric about the axis X and also symmetric about the axis Y.

Figure 3:
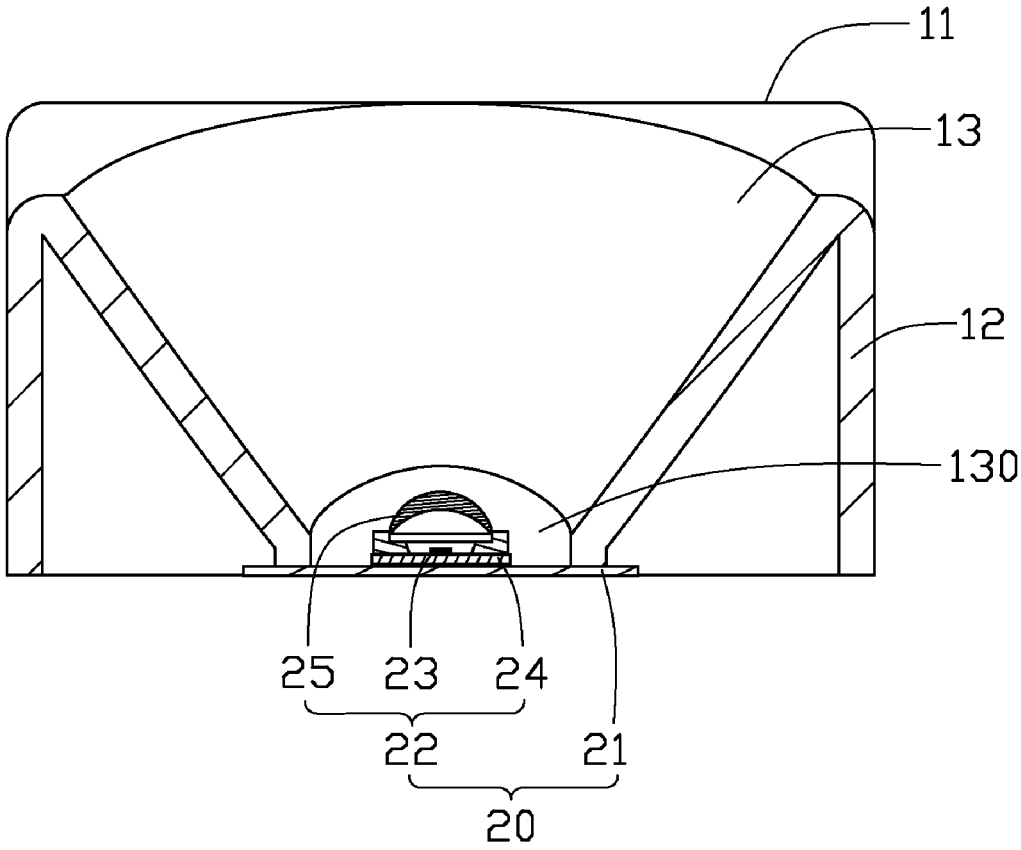
FIG. 3 is a cross-sectional view of FIG. 1 taken along line III-III thereof.
Figure 4:
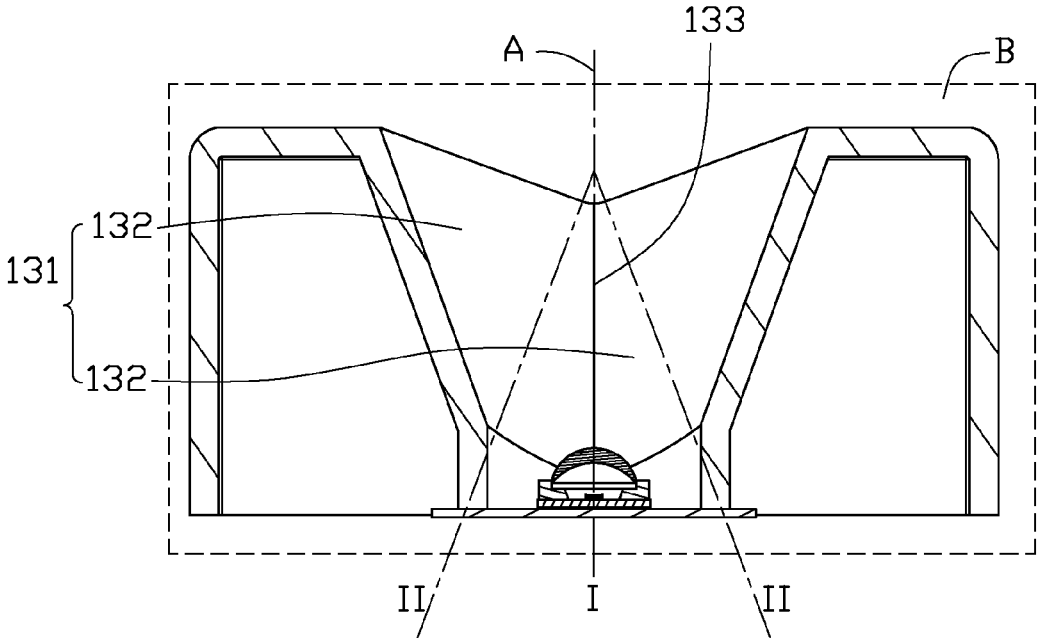
FIG. 4 is a cross-sectional view of FIG. 1 taken along line IV-IV thereof.

Referring to FIGS. 3-4, the LED module 20 includes a printed circuit board 21 and an LED 22 attached to a top surface of the printed circuit board 21. The LED 22 includes a substrate 24, an LED die 23 attached on a center of a top of the substrate 24, and an encapsulant 25 fixed on the top of the substrate 24 and sealing the LED die 23. The LED 22 is placed within the reflector 10 in such a matter that an optical axis of the LED 22, marked as an axis I in FIG. 4, is oriented vertically to the substrate 24. The encapsulant 25 has a dome-like shape for converging most of light emitted from the LED die 23 around the axis I.

Referring to FIG. 1 again, the reflector 10 is a substantially square block with a recessed bottom, and integrally made of a transparent material by a plastic injection molding. The reflector 10 includes a top wall 11 and a circumferential wall 12 extending vertically downwardly from a peripheral edge of the top wall 11. The top wall 11 defines a substantially V-shaped groove 14 at a middle portion thereof. The groove 14 extends through the top wall 11 along a direction parallel to the axis X, and has a center line (not labeled) at a bottom thereof parallel to the axis X. The center of the top wall 11 is recessed downwards to form a funnel-like light-reflecting unit 13 having a larger opening (not labeled) at a top thereof and a smaller round opening 130 at a bottom thereof. The light-reflecting unit 13 is located under the groove 14, and the larger opening of the light-reflecting unit 13 communicates with the groove 14. The printed circuit board 21 of the LED module 20 is mounted under the light-reflecting unit 13, and the LED 22 extends upwards through the opening 130 of the light-reflecting unit 13 to be received in the light-reflecting unit 13. The circumferential wall 12 encloses the LED module 20 therein for protecting it.

The light-reflecting unit 13 has a mirror finishing reflecting surface 131 for reflecting light emitted from the LED die 23 of the LED 22 out of the reflector 10. A first vertical plane A (see FIG. 4) is defined by a plane parallel to the axis X and through the axis I of the LED 22. The reflecting surface 131 includes two half-conical surfaces 132 which connect with each other and are symmetric about the first plane A. The two half-conical surfaces 132 may be not symmetric to the first plane A in other embodiments. In this embodiment, the half-conical surfaces 132 intersect with a top surface of the top wall 11 corresponding to the groove 14 to define two symmetric arcs. Each of the half-conical surfaces 132 has an axis II (see FIG. 4) which is inclined to the optical axis I. The two axes II are symmetric about the first plane A, and coplanar with the optical axis I of the LED 22 to cooperatively form a second vertical plane B. The second plane B is perpendicular to the first plane A and the top surface of the top wall 11. Furthermore, the first plane A is perpendicular to the top surface of the top wall 11. The axes II of the half-conical surfaces 132 intersect with the optical axis I at a point which is located over the LED 22. The symmetric half-conical surfaces 132 intersect with each other at two lines 133 located at the left and right sides of the reflector 10. The lines 133 and the center line of the groove 14 are on the first plane A; that is, the lines 133 and the center line of the groove 14 are coplanar with each other at the first plane A. In other embodiments, the reflecting surface 131 may be defined by other curved surfaces such as half-parabolic surfaces.

Figure 5:
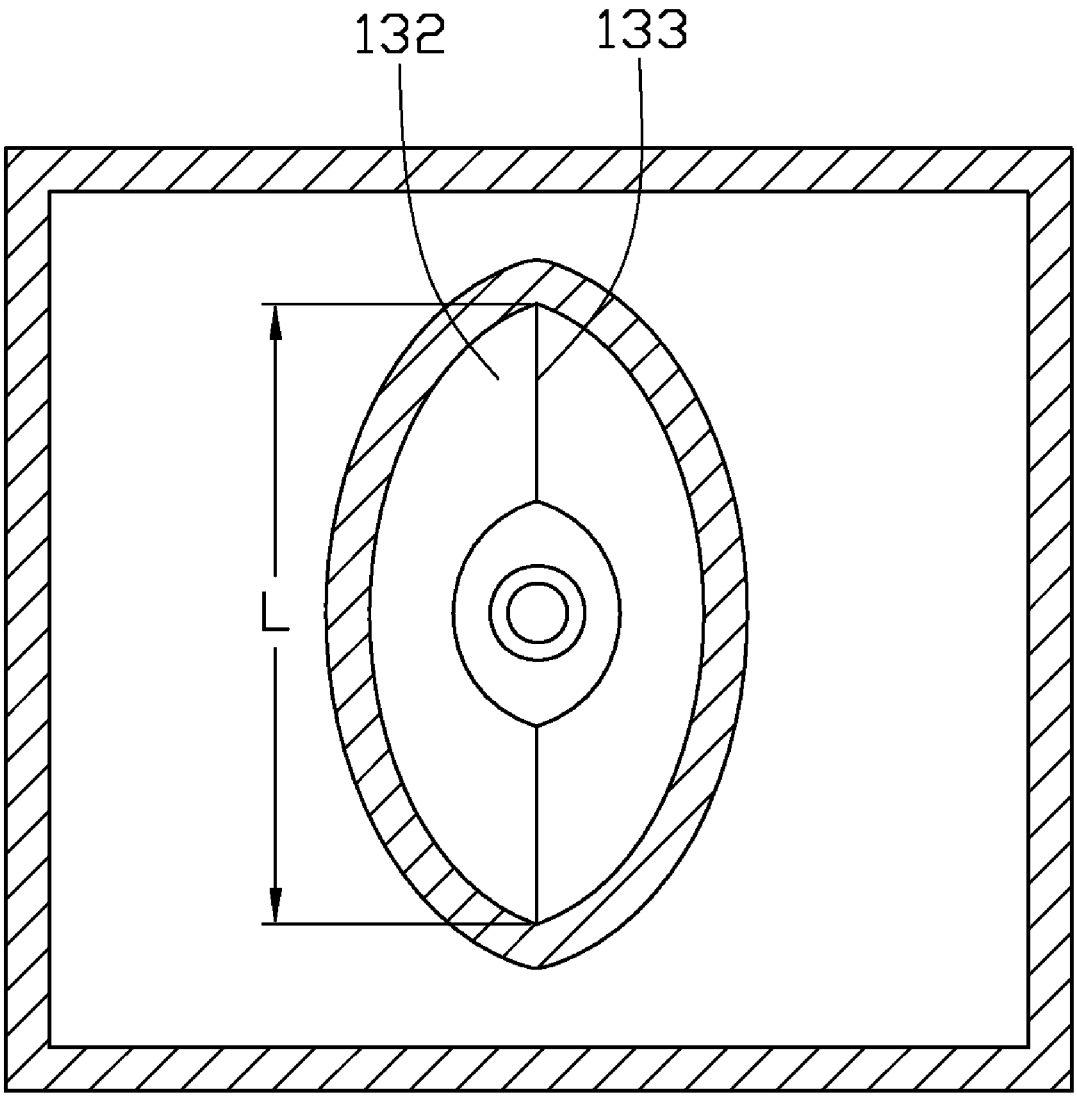
FIG. 5 is a cross-sectional view of FIG. 1 taken along line V-V thereof.

Also referring to FIG. 5, a plane C is defined by a cross section taken along line V-V of FIG. 1 and is a plane perpendicular to the optical axis I of the LED 22. A distance L between the two intersecting points of the lines 133 and the plane C is larger than a distance between any other two points of the reflecting face 131 intersecting with the plane C.

In use of the light-emitting unit of the disclosure, the LED 22 of the LED module 20 emits light and projects the light on the reflecting surface 131 of the reflector 10. The reflecting surface 131 reflects the light out of the reflector 10 in such a matter that a narrower light beam is presented at the front and rear sides of the reflector 10 and a wider light beam is presented at the left and right sides of the reflector 10. When the LED light-emitting unit of the disclosure is utilized on a road, the LED light-emitting unit is arranged in such a manner that the axis X is parallel to a length of the road and the axis Y is parallel to a width of the road. The wider light beam is projected in a length of the road to achieve a wider region illumination and the narrower light beam is projected in a width of the road to achieve a better illumination intensity distribution and a uniform illumination.

Figure 6:
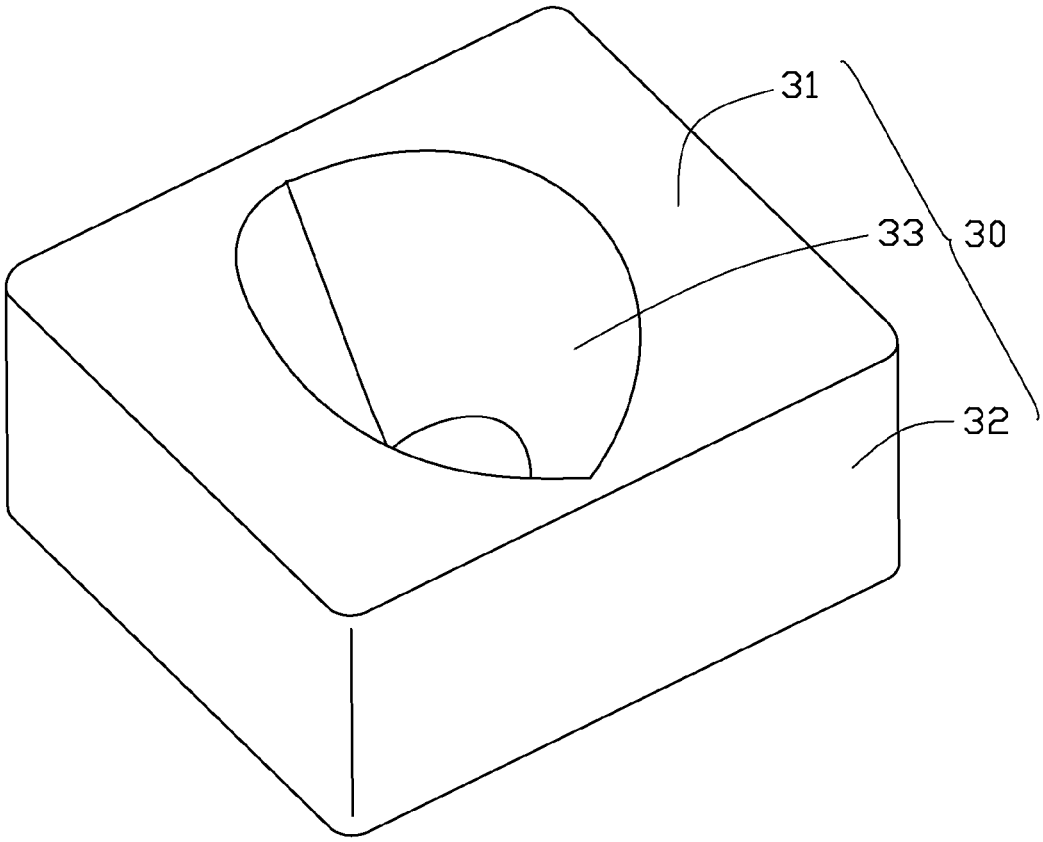
FIG. 6 is an isometric, assembled view of an LED light-emitting unit in accordance with a second embodiment of the disclosure.

Referring to FIG. 6, an LED light-emitting unit in accordance with a second embodiment is similar to the LED light-emitting unit of the first embodiment. The reflector 30 includes a top wall 31 and a circumferential wall 32 extending downwards vertically from a peripheral edge of the top wall 31. Non-groove is defined at the top wall 31; thus, the top wall 31 forms a planar top surface. A light-reflecting unit 33 is formed at a center of the top wall 31 of the reflector 30. The light-reflecting unit 33 has a same configuration as that of the light-reflecting unit 13.

Figure 7:
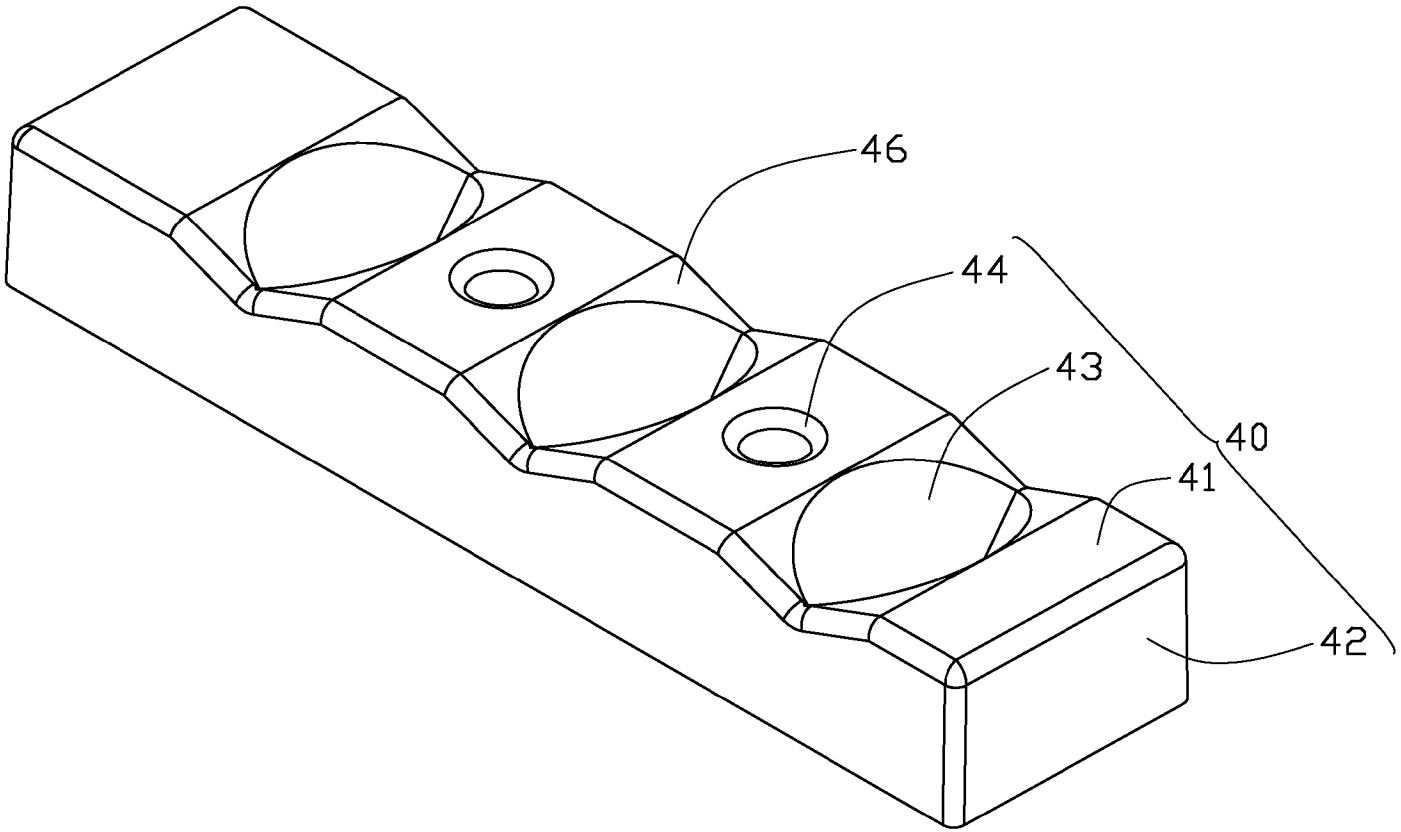
FIG. 7 is an isometric, assembled view of an LED light-emitting unit in accordance with a third embodiment of the disclosure.
Figure 8:
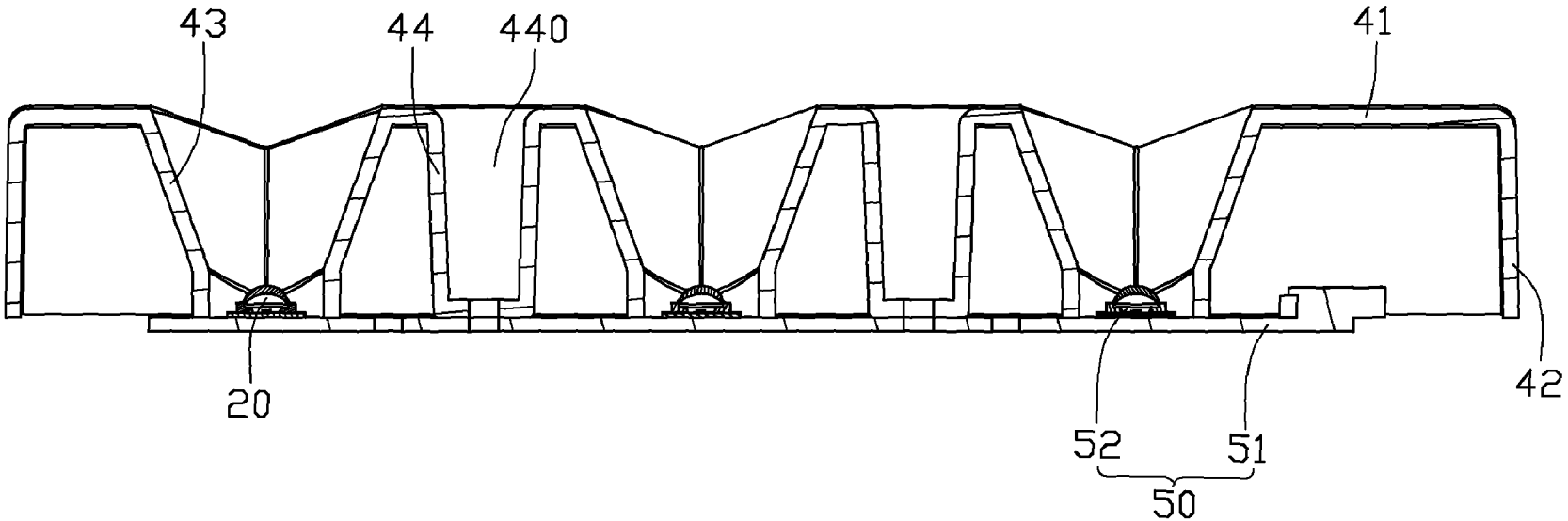
FIG. 8 is a cross-sectional view of FIG. 7.

Referring to FIGS. 7-8, an LED light-emitting unit in accordance with a third embodiment includes a reflector 40 and an LED module 50 mounted on a bottom of the reflector 40. The reflector 40 is a substantially rectangular block with a recessed bottom, and is made of transparent materials by a plastic injection molding. The reflector 40 includes a rectangular top wall 41 and a circumferential wall 42 extending vertically downwardly from a peripheral edge of the top wall 41. Three spaced, parallel light-reflecting units 43 and two mounting poles 44 which alternate with the light-reflecting units 43 are recessed downwards from the top wall 41. The light-reflecting units 43 each are identical to the light-reflecting unit 13 of the first embodiment. The first plane A of the light-reflecting unit 43 is perpendicular to a length of the top wall 41 of the reflector 40. The mounting poles 44 define through holes 440 so that fasteners (not shown) can extend through the mounting poles 44 to mount the LED light-emitting unit onto a frame of an LED lamp (not shown). The top wall 41 defines three V-shaped grooves 46 corresponding to the light-reflecting units 43. The grooves 46 each are identical to the groove 14 of the first embodiment.

The LED module 50 includes a rectangular printed circuit board 51 and three spaced LEDs 52 attached to a top surface of the printed circuit board 51. The LED 52 is identical to the LED 22 of the first embodiment. The LED module 50 is mounted on bottoms of the light-reflecting units 43, and the LEDs 52 extend upwardly through the bottom of the light-reflecting units 43 to be received therein. The circumferential wall 42 surrounds the LED module 50 to protect it. An amount of the light-reflecting units 43 and the mounting poles 44 can be changed according to actual needs.

Figure 9:
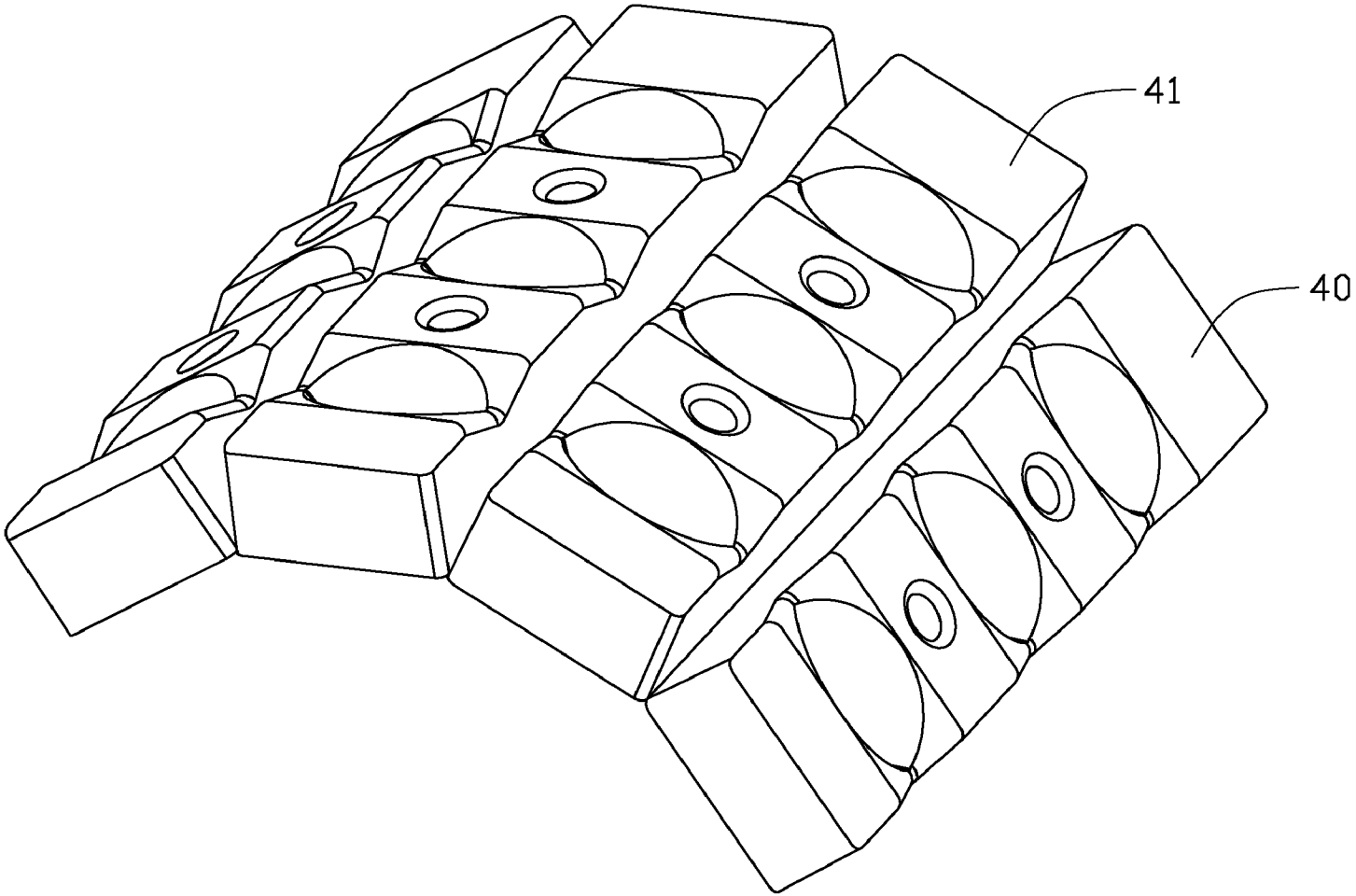
FIG. 9 is an isometric, assembled view of an LED light-emitting module employing a number of the LED light-emitting unit of FIG. 7.

Referring to FIG. 9, an LED light-emitting module employing four LED light-emitting units of the third embodiment of FIG. 8 is illustrated. The reflectors 40 of the LED light-emitting units are parallel to each other and symmetric about a center of the LED light-emitting module. The top surfaces of the top walls 41 of the reflectors 40 cooperatively form sides of a regular polygon. An angle between each of outer two reflectors 40 of the LED light-emitting module and a horizontal plane below the LED light-emitting module is larger than that between each of middle two reflectors and the horizontal plane. The angles between each reflector 40 and the horizontal plane, the amount of the reflectors 40 and the distance between two adjacent reflectors 40 can be changed according to actual needs. The LED light-emitting module is mounted to a frame of an LED lamp (not shown).

When the LED light-emitting module is used on a road, the reflectors 40 are arranged in such a manner that lengths of the reflectors 40 are perpendicular to the width of the road. The LEDs 52 emit light and project the light on the reflecting surfaces of the light-reflecting units 43. The reflecting surfaces of the reflectors 40 reflects the light out of the reflectors 40 in such a manner that a wider light beam is projected in a length of the road to achieve a wider region illumination and a narrower light beam is projected in a width of the road to achieve a better illumination intensity distribution and a uniform illumination.

The circumferential walls 12, 32, 42 of the reflectors 10, 30, 40 enclose corresponding light-reflecting units 13, 33, 43 to further protect the LED modules 20, 50 mounted in the reflectors 10, 30, 40, thereby lengthening the lifespan of the corresponding LED light-emitting units. That the reflectors 10, 30, 40 are formed by a plastic injection molding has many advantages, such as simple manufacturing process, low manufacturing cost and uniform manufacturing quality.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A reflector for reflecting light emitted from at least a light emitting diode (LED) element which is received in the reflector, the reflector comprising:

a top wall having a top surface; and at least a light-reflecting unit recessed downwardly from the top surface of the top wall, the at least a light-reflecting unit having a reflecting face for reflecting light generated by the at least an LED element upwardly through the top surface of the top wall, the reflecting face comprising two curved faces having axes intersecting with each other, the curved faces intersecting with each other at two lines, a distance between two intersecting points of the two lines with a cross section of the reflector which is parallel to the top surface of the top wall of the reflector being larger than that between any other two intersecting points of the reflecting face intersecting with the cross section of the reflector;

wherein each of the curved faces is one of a half-conical face and a half-parabolic face.

2. The reflector as claimed in claim 1 further comprising a circumferential wall extending downwards from a peripheral edge of the top wall, wherein the circumferential wall surrounds the at least an LED element to protect the at least an LED element.

3. The reflector as claimed in claim 2, wherein at least a groove is defined in the top wall, communicating with the at least a light-reflecting unit.

4. The reflector as claimed in claim 3, wherein the at least a groove has a V-shaped configuration and a center line at a bottom thereof, the lines formed by the intersected curved faces being coplanar with the center line at a plane perpendicular to the top surface of the top wall.

5. The reflector as claimed in claim 1, wherein the at least a light-reflecting unit includes a plurality of light-reflecting units, and two adjacent light-reflecting units are spaced from each other, a mounting pole being disposed between the two adjacent light-reflecting units.

6. An LED (light emitting diode) light-emitting unit comprising:

at least an LED light-emitting element having an optical axis;

a reflector having a top wall with a top surface, the reflector covering the at least a light-emitting element and comprising at least a light-reflecting unit recessed downwardly from the top surface of the top wall and located corresponding to the at least an LED light-emitting element so that light generated by the at least an LED light-emitting element is reflected by the at least a light-reflecting unit upwardly through the top surface of the top wall;

wherein the at least a light-reflecting unit has a reflecting face comprising two curved faces intersecting with each other at two lines, the curved faces having axes intersecting with each other, a distance between two intersecting points of the two lines with a cross section of the reflector which is parallel to the top surface of the top wall of the reflector being larger than that between any other two intersecting points of the reflecting face intersecting with the cross section of the reflector;

wherein the at least a light-reflecting unit includes a plurality of light-reflecting units, and two adjacent light-reflecting units are spaced from each other, a mounting pole being disposed between the two adjacent light-reflecting units.

7. The LED light-emitting unit as claimed in claim 6, wherein the axes of the curved faces are symmetric about the optical axis of the at least an LED light-emitting element.

8. The LED light-emitting unit as claimed in claim 7, wherein the axes of the curved faces are coplanar with the optical axis of the at least an LED light-emitting element.

9. The LED light-emitting unit as claimed in claim 8, wherein the axes of the curved faces intersect with the optical axis at a point which is located over the at least an LED light-emitting element.

10. The LED light-emitting unit as claimed in claim 6, wherein each of the curved faces is one of a half-conical face and a half-parabolic face.

11. The LED light-emitting unit as claimed in claim 6, wherein the reflector further comprises a circumferential wall extending downwards from a peripheral edge of the top wall and surrounding the at least an LED light-emitting element.

12. The LED light-emitting unit as claimed in claim 11, wherein at least a groove is defined in the top wall, communicating with the at least a light-reflecting unit.

13. The LED light-emitting unit as claimed in claim 12, wherein the at least a groove has a V-shaped configuration and a center line at a bottom thereof, the two lines formed by the two intersected curved faces being coplanar with the center line.

14. A reflector for reflecting light emitted from at least a light emitting diode (LED) element which is received in the reflector, the reflector comprising:

a top wall having a top surface;

at least a light-reflecting unit recessed downwardly from the top surface of the top wall, the at least a light-reflecting unit having a reflecting face for reflecting light generated by the at least an LED element upwardly through the top surface of the top wall, the reflecting face comprising two curved faces having axes intersecting with each other, the curved faces intersecting with each other at two lines, a distance between two intersecting points of the two lines with a cross section of the reflector which is parallel to the top surface of the top wall of the reflector being larger than that between any other two intersecting points of the reflecting face intersecting with the cross section of the reflector; and a circumferential wall extending downwards from a peripheral edge of the top wall, wherein the circumferential wall surrounds the at least an LED element to protect the at least an LED element;

wherein at least a groove is defined in the top wall, communicating with the at least a light-reflecting unit.

15. The reflector as claimed in claim 14, wherein the at least a groove has a V-shaped configuration and a center line at a bottom thereof, the lines formed by the intersected curved faces being coplanar with the center line at a plane perpendicular to the top surface of the top wall.

16. The reflector as claimed in claim 14, wherein the at least a light-reflecting unit includes a plurality of light-reflecting units, and two adjacent light-reflecting units are spaced from each other, a mounting pole being disposed between the two adjacent light-reflecting units.

* * * * *